United States Patent [19]

Sakai

[11] 3,966,062

[45] June 29, 1976

[54] APPARATUS FOR CHARGING RAW MATERIALS INTO BLAST FURNACES

[76] Inventor: Kiyotoshi Sakai, 3-503, 12, Tenjin 1-chome, Tobata, Kita-kyushu, Fukuoka, Japan

[22] Filed: Apr. 9, 1975

[21] Appl. No.: 566,441

[30] Foreign Application Priority Data

Apr. 15, 1974 Japan ..... 49-43068

[52] U.S. Cl. ..... 214/35 R; 266/183

[51] Int. Cl.[2] ..... F27B 1/20

[58] Field of Search ..... 214/35 R, 35 A, 18 V, 214/18.22, 18.24, 18.26, 18.28, 17 CB; 302/60; 266/27; 239/668, 669, 681

[56] References Cited

UNITED STATES PATENTS

| | | | |
|---|---|---|---|
| 1,223,626 | 4/1917 | Seymour | 214/18 V |
| 3,131,821 | 5/1964 | Tsujihata et al. | 214/35 R |

*Primary Examiner*—Albert J. Makay
*Attorney, Agent, or Firm*—Charles E. Pfund

[57] ABSTRACT

A hollow inverted frustum shaped rotary hopper is provided above the furnace top to receive the raw materials from a conveyor. Beneath the rotary hopper is disposed a hollow disc shaped impeller including a dish shaped central portion facing to the lower end of the rotary hopper and a plurality of wedge shaped vanes mounted on the periphery of the impeller for defining a discharge openings between adjacent vanes for throwing out the raw materials by centrifugal force. A stationary inclined chute means is provided including an annular hopper surrounding the impeller for charging the raw materials discharged by the vanes into the furnace top and inert gas is ejected into an annular gap defined between the covers of the impeller and the inclined chute means for preventing the gas in the blast furnace from leaking to the outside.

8 Claims, 11 Drawing Figures

APPARATUS FOR CHARGING RAW MATERIALS INTO BLAST FURNACES

BACKGROUND OF THE INVENTION

This invention relates to apparatus for charging raw materials into a blast furnace, and more particularly to an improved charging apparatus utilizing centrifugal force and the directivity of the streamline flow of gas. The raw material charging apparatus is the most important one among various apparatus mounted on the top of a blast furnace. In a method of charging the raw materials by utilizing a well known bell type raw material charging apparatus, in most cases raw materials having larger particle size and those having smaller particle size are separated from each other due to the parabolic force created at the time of charging with the result that the larger particles accumulate in an annular area inside the blast furnace whereas smaller particles in an area inside the annular area thus causing clogging phenomena. Such clogging forms a dense block of the mixture of the raw materials thus affording a high resistance to the gas rising in the furnace. In a method of charging the raw materials which uses one or a plurality of bells, there is a difficulty that the construction and operation of the charging apparatus are complicated. Recently, in many countries high pressure operations have become the object of the art because of their high efficiency and low cost and many efforts are still being made for further improving the operation. However, many problems still remain unsolved regarding air tight seals necessary for the high pressure operation and segregation of the charged raw materials, which is one of the defects of the bell type charging apparatus. In a modern large capacity blast furnace, the size of the lower bell reaches or exceeds the upper limit of the size that can be actually manufactured due to the increase in the pressure and the size of the charging plane. Such a large charging bell creates a number of additional problems encountered during use or exchange of the charging bell. The inventor has noted that in order to perfectly or at least partially solve these problems of the existing blast furnaces it is necessary to radically change the construction of the charging apparatus and that it is necessary to provide means for the charging apparatus that can greatly improve the operating efficiency of the furnace.

SUMMARY OF THE INVENTION

It is an object of this invention to provide an improved charging apparatus for a blast furnace having no air tightly sealed part which creates mechanical friction, and hence having a long operating life.

Another object of this invention is to provide a novel charging apparatus for a blast furnace which can decrease the speed of the gas rising in the furnace by charging the raw materials at an extremely high speed and high pressure thus decreasing the solution loss and increasing the efficiency of the furnace.

Still another object of this invention is to provide an improved charging apparatus for a blast furnace which can minimize the leakage of the furnace top gas through the air tight portion thus assuming the largest quantity of the charge commensurate with the capacity of the furnace.

Yet another object of this invention is to provide a charging apparatus for a blast furnace capable of decreasing the degradation of the mixture due to the segregation of the raw materials in the furnace thereby preventing troubles from occurring in the furnace.

A further object of this invention is to provide an improved charging apparatus for a blast furnace which can continuously and uniformly charge the raw materials into the blast furnace thus increasing the charging efficiency.

Another object of this invention is to provide an improved charging apparatus which can minimize the scattering of powdery ore and improve the efficiency of charging and environment conditions.

Yet another object of this invention is to provide an improved charging apparatus capable of minimizing the variation in the furnace top pressure when the raw materials are charged into the blast furnace thus simplifying the operation of the furnace.

According to this invention these and other objects can be accomplished by providing raw material charging apparatus for a blast furnace comprising a hollow inverted frustum shaped rotary hopper, conveyor means for supplying raw materials into the rotary hopper, a hollow disc shaped impeller disposed beneath the rotary hopper, the impeller including a dish shaped central portion facing to the lower end of the rotary hopper and a plurality of vanes mounted on the periphery of the dish shaped central portion for defining a plurality of discharge openings between adjacent vanes for throwing out the raw materials by centrifugal force, a stationary inclined chute means including an annular hopper surrounding the impeller for charging the raw materials discharged by the vanes into the top of the blast furnace, a cover for the impeller, and the lid for the inclined chute means, the lid encircling the cover with an annular gap therebetween, and means for ejecting inert gas into the annular gap for preventing gas in the blast furnace from leaking to the outside.

The vanes of the impeller takes the form of wedges and are arranged on a circle about the axis of the impeller for creating centrifugal force. The annular hopper is provided with an annular inlet opening facing to the discharge openings of the impeller in the horizontal direction and the inclined chute means comprises a plurality of S shaped downwardly inclined chutes, the upper ends of the chutes are opened in the annular hopper and the lower ends of the chutes protrude into the top of the blast furnace at such relative angular relationship that the streams of the raw materials discharged from respective chutes converge each other at a point a predetermined distance apart from the furnace top and then diverge each other.

DESCRIPTION OF THE PREFERRED EMBODIMENT

Figure 1:
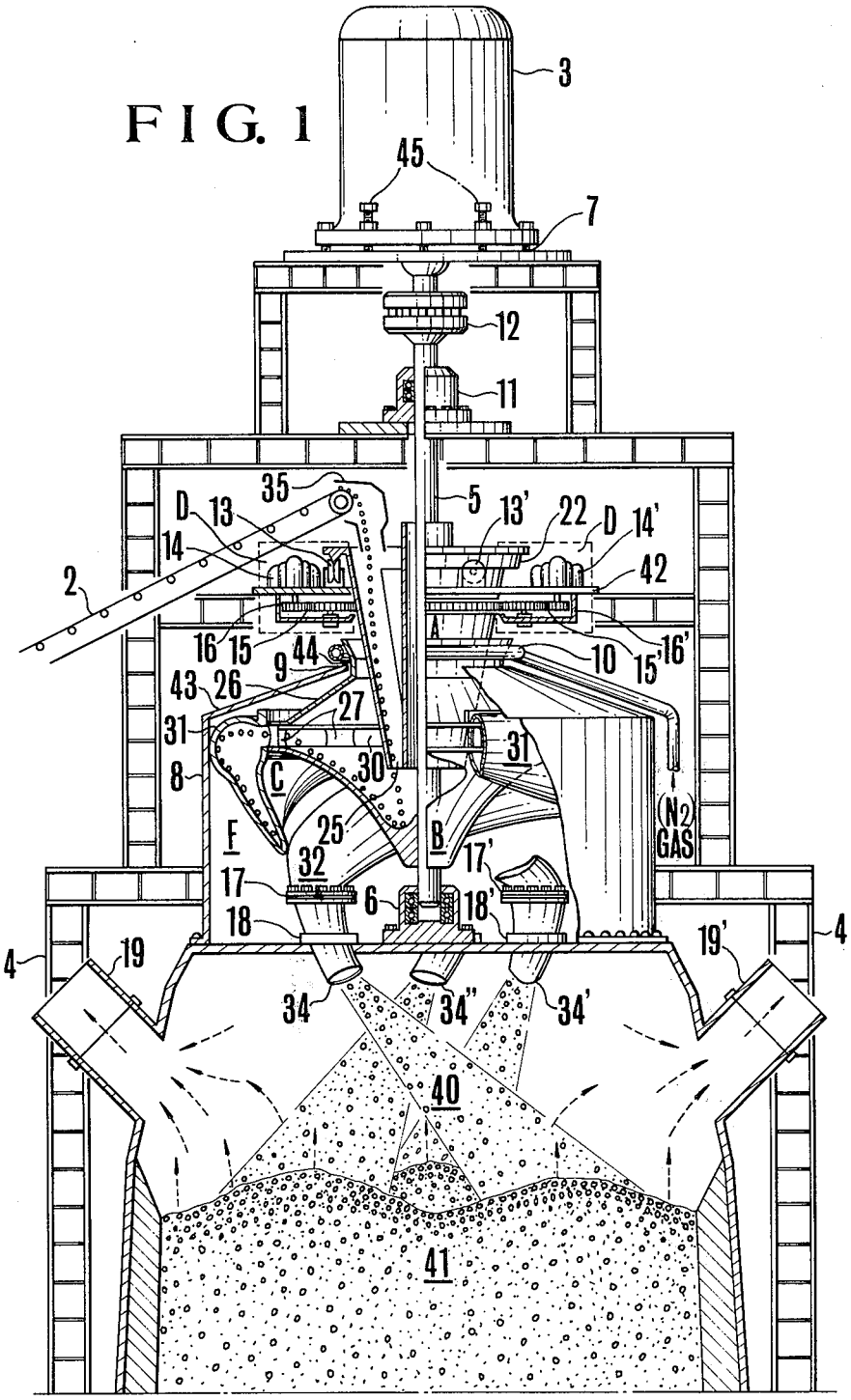
FIG. 1 is a longitudinal sectional view, partly broken away, showing a general arrangement of the novel charging apparatus embodying the invention.

Referring now to FIG. 1 of the accompanying drawings, a modern high efficiency blast furnace having a large inner diameter is generally designated by a reference numeral 1. In FIG. 1, only the important portions of the furnace top are shown. Above the furnace top are provided a rotary hopper A adapted to receive the raw materials from a belt conveyor 2 or an elevator (not shown) for successively charging the raw materials into the blast furnace, an impeller B in the form of a disc shaped hollow member having a conical inner surface for throwing the raw materials under a strong centrifugal force and disposed to receive the raw materials from the rotary hopper A which is driven by driving means D and D′ mounted on both sides of the hopper. The impeller B is driven by a motor 3 at the upper most position and a stationary inclined chute C surrounding the discharge opening of the impeller and having an inwardly and downwardly curved inner surface for supplying the raw materials into the blast furnace. The rotary hopper A, impeller B and their driving means D, D′ and 3 are supported by a keep shaped framework 4 independent of the furnace 1 so as to prevent the charging apparatus from being affected by the expansion, contraction and other undesirable phenomena of the furnace. More particularly, the impeller B is suspended as an integral unit by a shaft 5 connected to the shaft of the motor 3. The lower end of the connecting shaft 5 extends through the center of the impeller B and terminates in a dust proof ball bearing 6 so that the shaft 5 will not be affected by the expansion and contraction of the furnace 1.

Further, as will be described later, as the discharge openings of the impeller B and the inlet opening of the inclined chute C oppose each other in the horizontal direction it is possible to readily adjust the discharge openings in the vertical direction relative to the inlet opening by adjusting bolts 45 adapted to mount the driving motor 3. Since the inclined chute C is constructed to form passages which pass the furnace top gas in the opposite directions and since the inclined chute is fixed to surround the discharge openings on the periphery of the impeller B it is impossible to completely seal the chute so that a gas leakage of a small quantity is inevitable. Accordingly, for the purpose of preventing the gas from escaping into the atmosphere, the inclined chute C is completely surrounded by a top closed short cylinder 8 and the outer rim of the casing of the impeller B. Inert gas, for example nitrogen gas by-produced at the time of producing oxygen is ejected into a small annular gap 9 about a conical top 44 of the casing 26 of the impeller, thus preventing leakage to the atmosphere of the gas that has leaked into space F within the cylinder 8 from the discharge opening of the impeller. The nitrogen gas is ejected from a ring shaped nozzle 10 and by ejecting the nitrogen gas into the annular gap under a suitable pressure it is possible to prevent escape of the inside gas. As shown the upper end of the shaft 5 is supported by an intermediate bearing 11 and connected to the shaft of the motor 3 through a coupling 12. The bearing 6 is provided with means (not shown) for circulating lubricating oil and cooling water.

The rotary hopper A is supported by three wheels 13 and 13′ (only two are shown) which are disposed to revolve on a circle about the shaft 5 so as to rotate the hopper in the direction opposite to that of the impeller B. The rotary hopper A is rotated by driving motors 14 and 14′ through reduction gearings 15 and 15′ which are contained in dust proof casings or covers 16 and 16′. The furnace top is provided with pipes 19 and 19′ for discharging gas.

Having described the general arrangement of three essential components, that is the rotary hopper, the impeller and the inclined chute, their detailed construction will now be described as follows.

Figure 2:
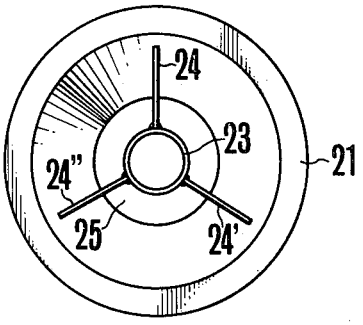
FIG. 2 is an upper view of a rotary hopper.
Figure 3:
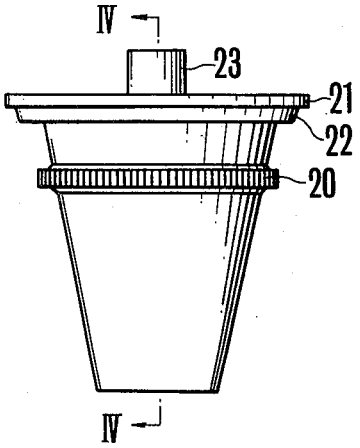
FIG. 3 is a side view of the rotary hopper.
Figure 4:
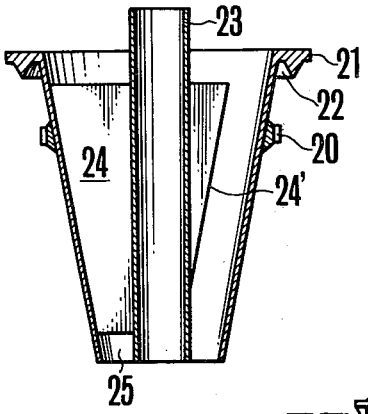
FIG. 4 is a sectional view of the rotary hopper taken along a line IV — IV shown in FIG. 4.

As shown in FIGS. 2, 3 and 4, the rotary hopper A takes the form of an inverted frustum with a ring shaped gear 20 on the side surface. A downwardly projecting annular rail 22 is formed on the under surface of the upper flange 21 and a tube 23 of a small diameter is supported at the axial center by means of a plurality of partition plates 24, 24′ and 24″. A narrow annular discharge opening 25 is formed at the bottom so as to discharge the raw materials into the inlet opening of the impeller which is formed about shaft 5. More particularly, as shown in FIG. 1 the lower end of the rotary hopper A projects into the impeller B so as to uniformly distribute the raw materials at the central portion of the impeller thus preventing uneven loading thereof and assuring sufficiently high centrifugal force. As shown in FIG. 1, the ring gear 20 is driven by driving means 14 and 14′ through gearings 15 and 15′ to rotate about shaft 5 at a low speed, for example 20 r.p.m. The purpose of wheels 13 and 13′ is to rotatably support the annular rail 22 and hence the rotary hopper. The wheels and the rail is suitably covered to prevent foreign matters from being jammed between the wheels and the rail. Thus, the position of the center of gravity of the rotary hopper is stabilized to prevent any gyration or eccentric rotation. As shown in FIG. 1, as the lower end of the rotary hopper projects into the impeller through an opening at the center of casing 26, it is necessary to take care to hold the hopper not to contact the casing 26.

Figure 5:
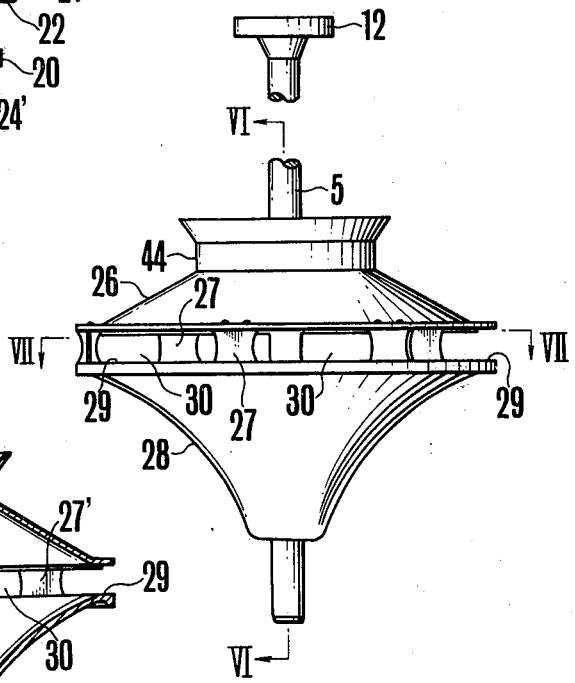
FIG. 5 is a side view of a charging impeller.
Figure 6:
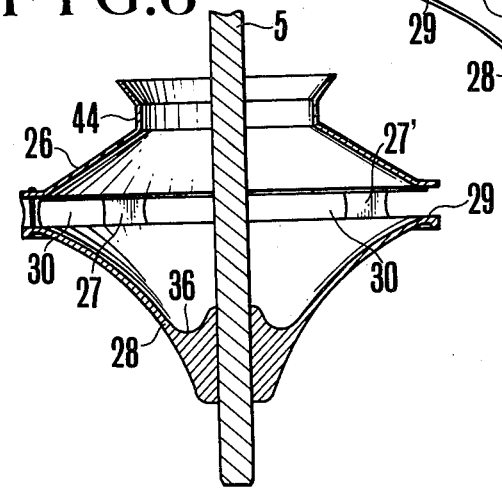
FIG. 6 is a longitudinal sectional view of the charging impeller taken along a line VI — VI shown in FIG. 5.
Figure 7:
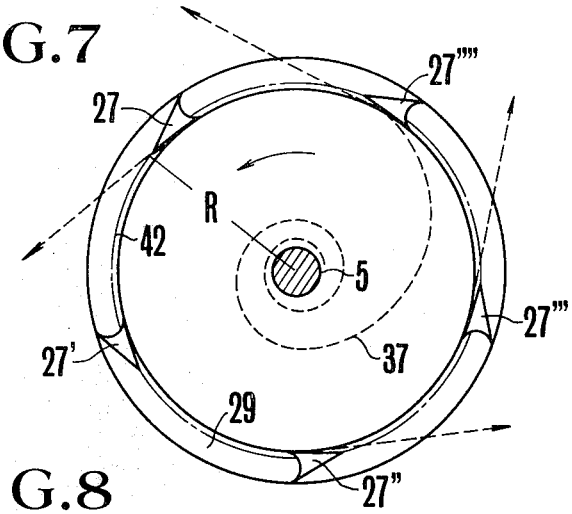
FIG. 7 is a cross-sectional view of the charging impeller shown in FIG. 5 taken along a line VII — VII.

Turning now to the impeller B, as shown in FIGS. 5, 6 and 7 it comprises a bottom conical dish shaped member 28 gradually flaring outwardly, a plurality of wedge shaped vanes 27, 27′, 27″ . . . equally spaced about the peripheral flange 29 of the dish shaped member 28 and an inverted conical cover 26 which is mounted on the vanes so as to form a thin disc shaped vane chamber. The impeller B having the construction described above is suitable for high speed rotation and is easy to mount on the shaft 5. Narrow openings 30 between adjacent vanes act as the discharge openings for the raw materials. The impeller has the following advantages.

Figure 9:
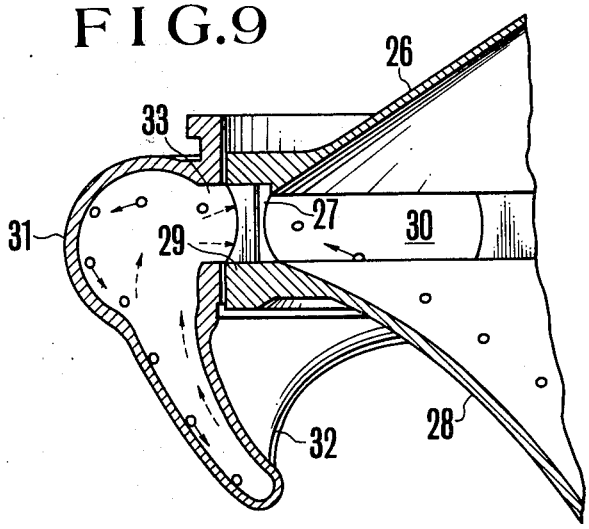
FIG. 9 is partial sectional view of the charging impeller and an inclined chute hopper which are in an ideal condition in which they are opposing in a horizontal plane.

1. It imparts a strong centrifugal force to the raw materials thus enabling continuous charging of the raw materials into the downwardly extending chutes 32, 32′ and 32″ from the bottom of the hopper 31. An annular inlet opening is formed at the inner upper side of the chute 31 whereby the raw materials received in the inlet opening 33 flow downwardly through respective chutes. As shown in FIGS. 1 and 9, the inlet opening 33 faces to the discharge openings 30 in the horizontal direction.

The discharged raw materials do not fall freely under their own weight but are thrown along tangential lines to the circle 42 on which the wedge shaped vanes 27, 27′, 27″ . . . are arranged, so that the inclined chutes are designated to guide the raw materials received through the inlet openings 33 along slightly eccentric curved surfaces which are shaped to reduce as far as possible reflecting blast furnace.

2. It is possible to effectively seal the gas regardless of the gas pressure in the furnace top.

3. It is possible to charge pulverized ore which is difficult with conventional charging apparatus.

4. It is possible to release partial, accidental abnormal gas of a pressure above the permissible gas.

5. It prevents invasion of the atmosphere even when the pressure in the furnace decreases below the atmospheric pressure.

6. It minimizes the variation in the pressure at the furnace top at the time of charging.

Figure 10:
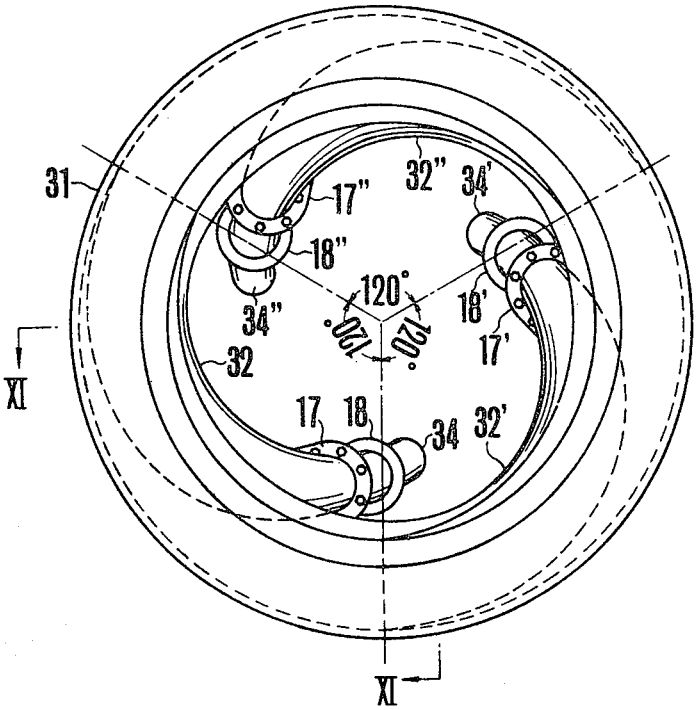
FIG. 10 is an upper view of the inclined chute.
Figure 11:
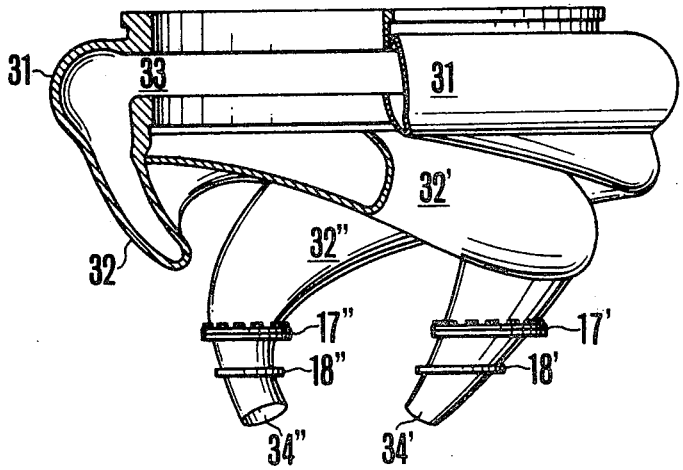
FIG. 11 is a side view, partly broken away, of the inclined chute.

As shown in FIGS. 9, 10 and 11, the inclined chute C comprises an annular hopper 31 surrounding the discharge openings 30 of the impeller, and a plurality of letter S shaped surfaces and to discharge the raw materials obliquely and downwardly into the blast furnace (See FIG. 1.). The lower ends of the inclined chutes project into the furnace top and equally spaced on a circle having a center on the longitudinal axis of the furnace. The angle of inclination of the lower ends of the inclined chutes are selected to a suitable value in accordance with the capacity of the blast furnace. Preferably, the angle is selected such that the raw materials are deposited in the form of pyramids. The inclined chutes have quite different construction from that of conventional charging apparatus. In other words, the inclined chutes have independent inlet openings 34, 34′ and 34″ and can smoothly charge the low materials into the blast furnace through S shaped twisted passages.

By the novel combination of the rotary hopper A, the impeller B and the inclined chutes C described above it is possible to continuously or discontinuously charge the raw materials by a strong centrifugal force without imposing any eccentric load on the impeller. Due to unique configuration of the wedge shaped vanes mounted on the periphery of the impeller a continuous ring shaped air tight zone is formed along the path of circular movement of the vanes, the air tight zone being never interfered by or interfer the raw materials being charged or not affected by the pressure in the furnace top thus forming an ideal charging zone in the furnace.

Suppose now that the rotary hopper A is rotated in the clockwise direction by the driving devices *d* and *d′* at a low of about 20 r.p.m. and that the impeller B is rotated at a high speed in the counterclockwise direction by the driving motor 3, the raw materials conveyed by the belt conveyor 2 pass through a surge hopper 35, flow downwardly along the inner surface of the rotary hopper A and then drop toward the central portion of the impeller B through narrow passage 25. This arrangement is extremely efficient to prevent an eccentric load on the impeller and hence to prevent an unbalanced load which causes vibration of the impeller. Due to the strong centrifugal force imparted the impeller rotating at a high speed and due to the dish shaped configuration of the central portion of the impeller, the raw materials are thrown outwardly and upwardly along spiral paths as shown by dotted lines in FIG. 7. Since the peripheral flange 29 at the top of these paths is horizontal the raw materials thrown upwardly along parabolic and spiral paths and reach the flange 29 are releaved from the action of gravity and side pressure and thrown outside of the impeller wheel B along linear paths at the speed which the particles have when they reach the flange 29. Small particles or dust are entrained in the air revolving about the axis of the shaft 5 and rising upwardly along a parabolic path. Thus, the dust collides upon the inner surface of the cover 26 which inclines downwardly from the center toward the periphery. Due to this inclined surface the dust finally merges with the raw materials which rise along the inner surface of the dish shaped portion 28 and thrown in the direction of tangential lines to the circle 42 on which the wedge shaped vanes 27 are arranged. Although the raw materials are imparted with a large velocity energy but resisted by the pressure in the furnace top which increases as the particles approaches to the furnace top because a large pressure difference between the atmosphere and the furnace top acts upon both sides of each vane and the loci thereof. However, since the inlet opening 33 of the stationary annular hopper 31 of the inclined chutes is located concentric with the impeller and close to the discharge openings on the periphery of the impeller B and since these openings oppose each other in the horizontal direction all raw materials discharged are received by the inlet opening 33 and then smoothly discharged into the furnace top and the curved inner surface of the annular hopper 31 and the S shaped chutes 32. As described above and shown in FIG. 1 as the discharge openings 34, 34′ and 34″ at the lower ends of the inclined chutes C incline and project downwardly into the furnace top the streams of the raw materials ejected from these discharge openings do not collide each other but approach each other at a suitable distance from the discharge openings and then diverge toward lower, this forming an ideal charging zone 41 in which large and small particles of the raw material are well mixed together.

As described hereinabove, there are provided three inclined chutes C which are pointed toward predetermined three points on the charging plane. Coke and lime stone can be charged with relatively small friction, but hard raw materials containing metal components such as iron ore and pellets tend to form scratches on the inner surfaces of the hopper 31 and chutes 32 so that it is advantageous to coat these surfaces with suitable wear resisting linings. To enable ready and rapid exhange and repair of the inclined chutes C they are connected to the discharge openings 34, 34′ and 34″ through flange couplings 77. The discharge openings are supported on the top wall of the furnace by supporting flanges 18.

Figure 8:
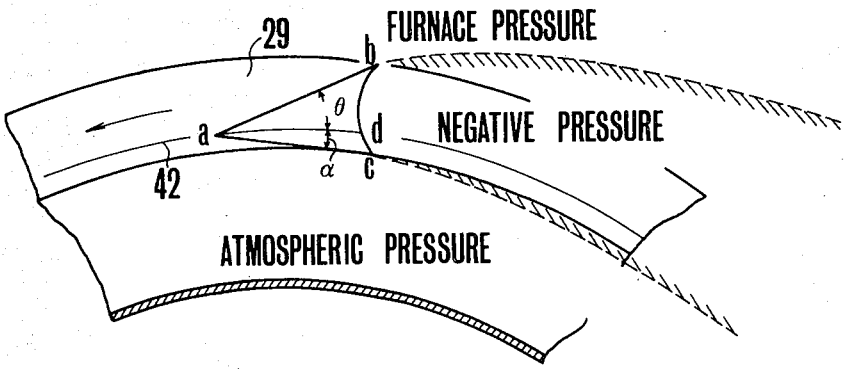
FIG. 8 is a diagram showing the deflection angle of a wedge shaped vane.

The gas in the furnace is shielded in the following manner. More particularly, the impeller B is constructed to be a disc shaped hollow member and the vanes 27 are wedge shaped for the purpose of increasing the fluid efficiency and to accelerate the raw material particles to a high speed. The wedge shaped vanes are arranged to intercept or shield the out flow of the furnace gas. More particularly, as the impeller rotates at a high speed, to the rear of the wedge shaped vanes are continuously formed negative pressure regions of dilute air or furnace top gap which are effective to isolate the furnace gas from the atmosphere. Analyzing in more detail, as can be noted from the enlarged view shown in FIG. 8, as the pointed leading edge *a* of each vane is subjected to the atmospheric pressure it is located substantially on the prescribed circle 42 so that the inner side *a–c* makes an angle $\alpha$ with respect to the circle 42. However, the outer side a–p is disposed to intersect the circle at an angle $\theta$ which is determined in accordance with pressure in the furnace top. Accordingly, as the impeller rotates at a high speed, the air or gas is pushed aside thus lowering the pressure on the rear side of the vane thereby forming ring shaped region of a negative pressure. Assume now that the diameter of the circle 42 on which the vanes are arranged is equal to 3 meters and that the impeller is rotated at a speed of 1,500 r.p.m. the peripheral speed of the impeller would be 14 km/min. or 235m/sec, so that even under a substantially large pressure difference no gas flows through the ring shaped region of the negative pressure, or if any, the gas flow is very little, thus substantially completely prevents the gas in the furnace top from flowing to the outside. This shielding effect is increased as the furnace pressure increases because the repulsive force created by the elastic collision of gas molecules acts strongly upon the vanes thus greatly increasing the shielding effect. As can be noted from the foregoing description so long as the speed of the impeller B is maintained at a constant value, it is possible to maintain the furnace top pressure at a constant value irrespective of the diffusion of the furnace gas. In other words if a rotating speed of the impeller corresponding to a predetermined pressure were maintained, this pressure would be automatically maintained by releasing partial or abrupt pressure rise of the furnace top gas which is greater than the permissible pressure rise in the furnace top gas. During such release of the abnormal pressure the raw material charging surface will not be affected. On the other hand when the pressure of the furnace top gas becomes negative, the invasion of the outside atmosphere is effectively prevented by the inclination angle $\alpha$ of the inner sides of respective vanes. It is also possible to provide a suitable device for controlling the speed of the impeller upon occurrence of an emergency so as to control the furnace pressure.

During the charging process are caused to fly at an extremely high speed around the periphery of the impeller and through the narrow discharge openings 30 between adjacent vanes. Thus, in the novel charging apparatus of this invention there is no element which is required to be maintained air tight or accompany friction, which is one of the outstanding advantages of this invention when compared with prior art charging apparatus for a blast furnace. While the inclined chutes form passages permitting outflow of the furnace top gas or dust having high temperature harmful to the charging apparatus. However, the annular air seal zone created by the high speed rotation of the impeller efficiently intercepts the outflow of such high temperature gas and dust thus protecting the charging apparatus from damage and warping or deformation.

In this manner all objects described above can be efficiently accomplished. Thus, according to the novel charging apparatus of this invention utilizing the acceleration imparted by centrifugal force and the directivity of the streamline flow of gas it is possible to continuously charge the raw materials into a blast furnace while maintaining a perfect air tight seal for the charging apparatus irrespective of the pressure difference between the atmosphere and the inside of the furnace top. Further, the furnace top pressure can be controlled as desired by varying the speed of the vanes of the impeller. Due to these advantages it is possible to charge mixtures of raw materials of different compositions. Furthermore it is possible to decrease the degradation of the mixture of the raw materials which is liable to occur when different raw materials, for example iron ore, coke or a slag forming agent are charged thus decreasing the segregation of the raw materials in the blast furnace whereby the condition in the blast furnace can be readily controlled.

As has been pointed out above as the impeller B is used not only to throw the raw materials but also to shield and diffuse the furnace gas, the material, configuration, arrangement, size, inclination angle, etc. of the vanes of the impeller should be carefully designed and selected.

What is claimed is:

1. Raw material charging apparatus for a blast furnace comprising a hollow inverted frustum shaped rotary hopper, conveyor means for supplying raw materials into said rotary hopper, a hollow disc shaped impeller disposed beneath said rotary hopper, said impeller including a dish shaped central portion facing to the lower end of said rotary hopper and a plurality of vanes mounted on the periphery of said dish shaped central portion for defining a plurality of discharge openings between adjacent vanes, for throwing out the raw materials by centrifugal force, a stationary inclined chute means including an annular hopper surrounding said impeller for charging the raw materials discharged by said vanes into the top of said blast furnace, a cover for said impeller and a lid for the said inclined chute means, said lid encircling said cover with an annular gap therebetween, and means for ejecting inert gas into said annular gap for preventing the gas in said blast furnace from leaking to the outside.

2. The charging apparatus according to claim 1 wherein said impeller is mounted on a vertical shaft driven by driving means mounted above said rotary hopper, said vertical shaft extends through the center of said rotary shaft, and the lower end of said shaft is journaled in a bearing mounted on the top of said blast furnace.

3. The charging apparatus according to claim 2 wherein said rotary hopper is driven by an independent driving means.

4. The charging apparatus according to claim 1 said vanes have the form of wedges and are arranged on a circle about the axis of said impeller.

5. The charging apparatus according to claim 4 wherein each vane has the form of a triangle and the angle between one side of said triangle subjected to the atmospheric pressure and said circle is made to be larger than the angle between the other side of said triangle subjected to the pressure in the top of said blast furnace and said circle so as to throw at high speeds the raw materials in the direction of tangent to said circle.

6. The charging apparatus according to claim 1 wherein said annular hopper is provided with an annular inlet opening facing to said discharge openings of the impeller in the horizontal direction.

7. The charging apparatus according to claim 1 wherein said inclined chute means comprises a plurality of S shaped downwardly inclined chutes, the upper ends of said chutes are opened in said annular hopper and the lower ends of said chutes protrude into the top of said blast furnace at such relative angular relationship that the streams of the raw materials discharged from the respective chutes converge each other at a point a predetermined distance apart from the furnace top and then diverge each other.

8. The charging apparatus according to claim 1 wherein the cover of said impeller takes the form of an inverted funnel having a cylindrical portion having a small diameter and encircling said rotary hopper and a downwardly inclined portion extending between said cylindrical portion and the periphery of said impeller for guiding the dust deposited on the inner surface of said inclined portion toward said discharge openings, and said lid for said inclined chute takes the form of a hollow frustum, the upper end thereof encircling said cylindrical portion with said annular gap therebetween.

* * * * *